US009297127B2

(12) United States Patent
Mettler et al.

(10) Patent No.: US 9,297,127 B2
(45) Date of Patent: Mar. 29, 2016

(54) BARRICADE ASSEMBLY WITH FOLDABLE LEGS

(71) Applicant: Plastic Safety Systems, Inc., Cleveland, OH (US)

(72) Inventors: Charles M. Mettler, Perry, OH (US); Gregory H. Brown, Chagrin Falls, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 60 days.

(21) Appl. No.: 14/336,200

(22) Filed: Jul. 21, 2014

(65) Prior Publication Data

US 2015/0027645 A1 Jan. 29, 2015

Related U.S. Application Data

(60) Provisional application No. 61/857,472, filed on Jul. 23, 2013.

(51) Int. Cl.
*A47G 5/00* (2006.01)
*E01F 13/02* (2006.01)

(52) U.S. Cl.
CPC ..... *E01F 13/02* (2013.01)

(58) Field of Classification Search
CPC ..... E01F 13/02; E01F 13/022; E04H 17/14; F16M 11/38
USPC ..... 160/351, 377; 248/166–173, 432, 440, 248/440.1; 297/16.2, 55, 56, 46
See application file for complete search history.

(56) References Cited

U.S. PATENT DOCUMENTS

| | | | | | |
|---|---|---|---|---|---|
| 2,944,354 | A * | 7/1960 | Sellon, Jr. | D06F 81/04 | 108/119 |
| 3,527,434 | A * | 9/1970 | Mauro | E01F 9/012 | 248/163.2 |
| 3,799,507 | A | 3/1974 | Rizzo | | |
| 4,298,186 | A | 11/1981 | Glass | | |
| 4,372,536 | A * | 2/1983 | Morse | E01F 13/02 | 256/64 |
| 5,240,217 | A * | 8/1993 | Lizakowski | E01F 13/02 | 182/151 |
| 5,458,434 | A | 10/1995 | Bent et al. | | |
| 5,509,360 | A * | 4/1996 | Chiu | A47B 3/02 | 108/119 |
| 5,544,614 | A | 8/1996 | Cushman | | |
| 7,523,715 | B2 * | 4/2009 | Mettler | A47B 23/042 | 116/63 R |
| 8,302,937 | B2 | 11/2012 | Mettler et al. | | |
| 2008/0213041 | A1 * | 9/2008 | Lipniarski | E01F 13/02 | 404/6 |

* cited by examiner

*Primary Examiner* — Syed A Islam
*Assistant Examiner* — Jeremy Ramsey
(74) *Attorney, Agent, or Firm* — Renner, Otto, Boisselle and Sklar, LLP

(57) ABSTRACT

A barricade assembly comprises a pair of laterally spaced uprights for supporting at least one barricade board, and a foldable leg assembly for selectively supporting the uprights in a generally upright position. The leg assembly comprises two pairs of legs, one of which has a sliding connection with the respective uprights, and the other of which has a pivotal connection with the respective legs of the one pair and with the respective uprights. When the legs of both pairs are unfolded, the legs of both pairs support the uprights in a generally upright position, whereas when the legs of both pairs are folded, the legs of the one pair are nested within the legs of the other pair substantially in line with the inner sides of the respective uprights to provide a substantially flat barricade assembly for ease of stacking of a plurality of such barricade assemblies on top of one another during storage and/or transit.

15 Claims, 5 Drawing Sheets

BARRICADE ASSEMBLY WITH FOLDABLE LEGS

CROSS-REFERENCE TO RELATED APPLICATIONS

This application claims the benefit of U.S. Provisional Application Ser. No. 61/857,472, filed Jul. 23, 2013, the entire disclosure of which is incorporated herein by reference.

FIELD OF THE INVENTION

This invention relates generally to a barricade assembly with foldable legs for selectively supporting the barricade assembly in a generally upright position.

SUMMARY OF THE INVENTION

The barricade assembly comprises a pair of laterally spaced uprights for supporting at least one barricade board, and a foldable leg assembly comprising two pairs of legs which, when unfolded, support the uprights in a generally upright position, and when folded, are nested within one another to provide a substantially flat barricade assembly for ease of stacking of a plurality of such barricade assemblies one on top of another during storage and/or transit.

These and other objects, advantages, features and aspects of the present invention will become apparent as the following description proceeds.

DETAILED DESCRIPTION

Figure 2:
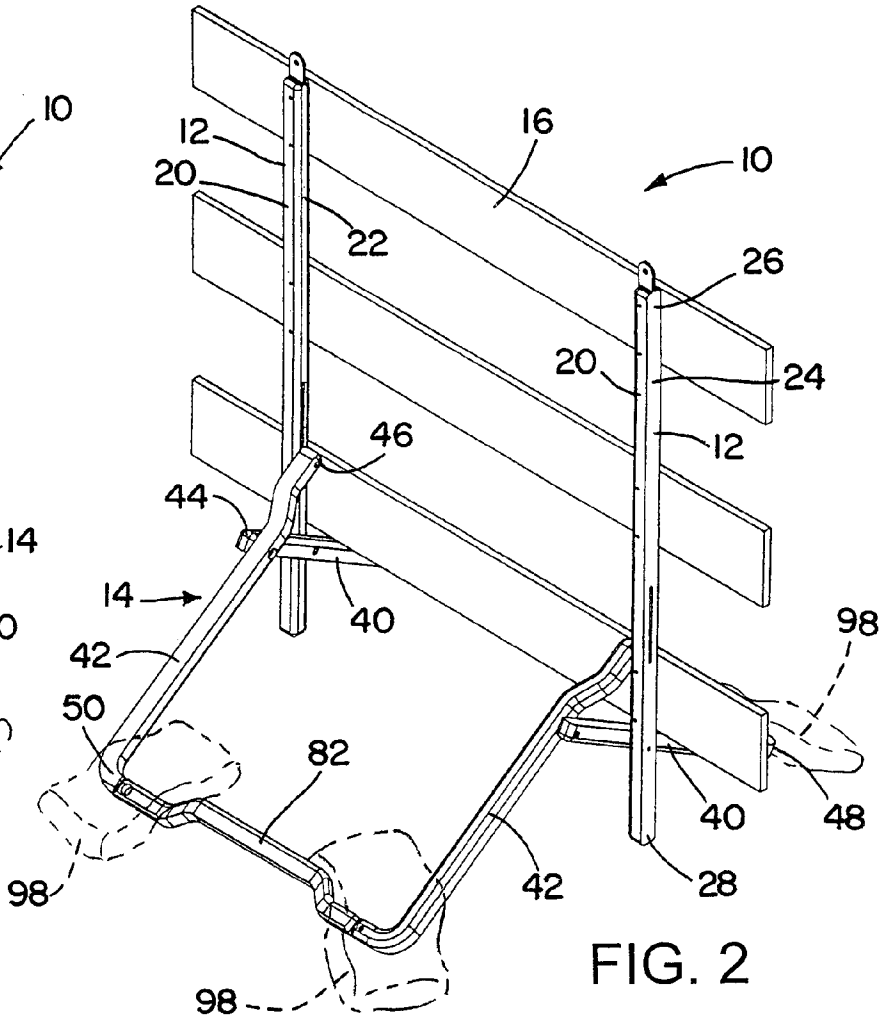
FIG. 2 is a rear perspective view of the unfolded barricade assembly of FIG. 1.

Referring now in more detail to the drawings, in which the same reference numbers are used to refer to like elements throughout, and initially to FIGS. 1-5, there is shown an exemplary embodiment of a barricade assembly 10 of the present invention comprising a pair of uprights 12 supported in a generally upright position by a foldable leg assembly 14 as described hereafter. Throughout the drawings, three barricade boards 16 are shown attached to the front side of the uprights 12 to provide for example a type III barricade assembly for use on construction sites and the like. However, it should be understood that more or less than three barricade boards may be attached to the uprights if desired. Also the uprights may be used for other purposes as well including, for example, to support portable signs or the like.

The board-like members 16 may be made of any suitable material including plastic or other material having the requisite strength. However, preferably the boards are molded out of a suitable plastic material to provide relatively high strength reinforced cores that permit the wall thickness of the boards to be made less than conventional extruded boards and still have substantially the same relative strength and stiffness as disclosed for example in U.S. Pat. No. 7,536,973, the entire disclosure of which is incorporated herein by reference.

Each of the uprights 12 has front and back sides 18 and 20, inner and outer sides 22 and 24, and upper and lower ends 26 and 28. The upper end 26 of the uprights may be stepped to provide a transversely extending support surface 30 for supporting a light thereon. Also the uprights 12 may be made relatively lightweight and still have the desired strength and rigidity as by molding the uprights out of a suitable plastic material.

Suitable mounting holes 32 (see FIG. 3) may be molded to extend completely through the uprights 12 for ease of installation of mounting bolts (not shown) for attaching one or more barricade boards 16 to the front sides 18 of the uprights in spaced relation from one another intermediate the ends of the uprights. Alternatively, standard hollow metal or plastic tubing may be used for the uprights if desired.

Figure 3:
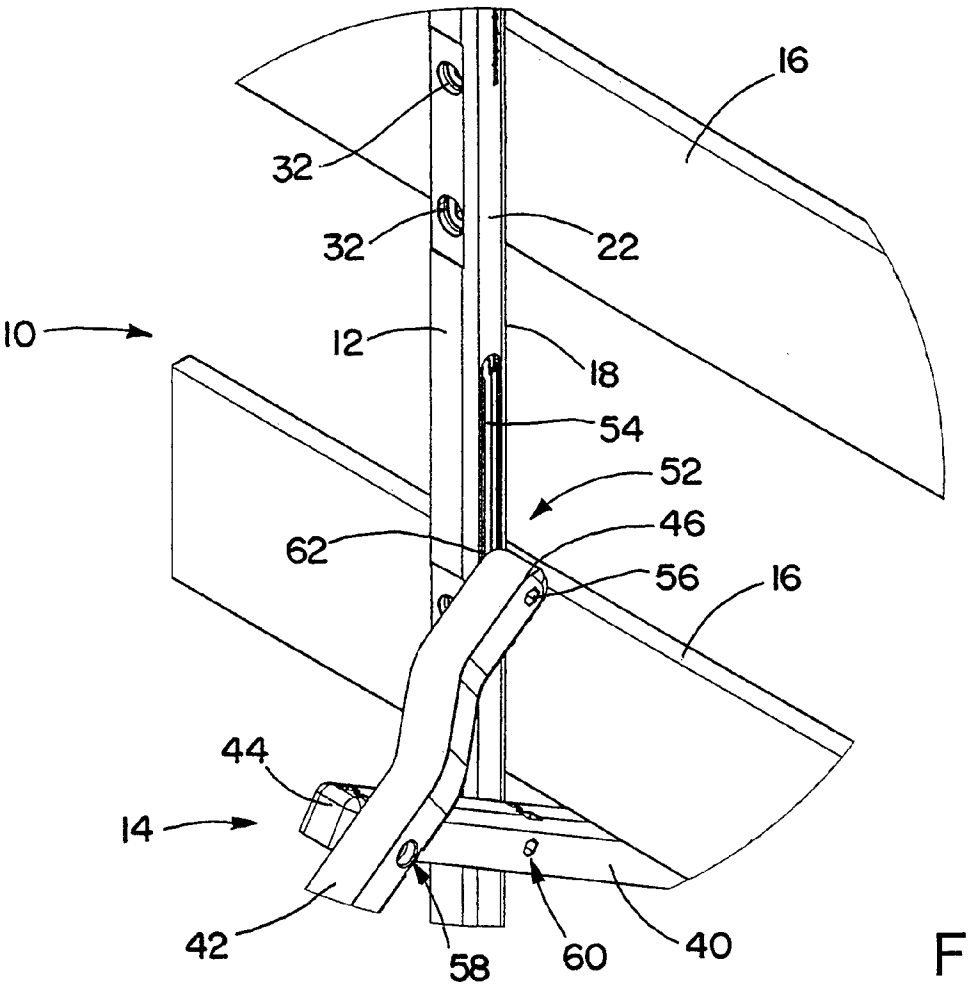
FIG. 3 is an enlarged fragmentary perspective view of a portion of the barricade assembly of FIG. 2 showing how the foldable legs are connected to the respective uprights of the barricade assembly and to each other.
Figure 4:
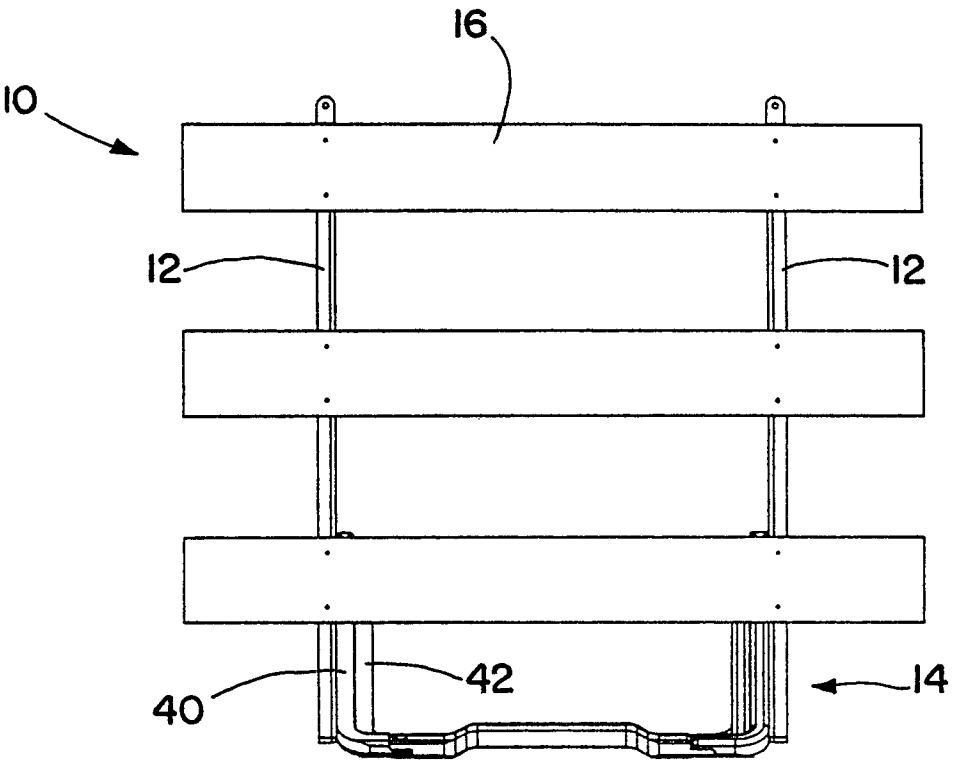
FIG. 4 is a front elevation view of the unfolded barricade assembly of FIG. 1.
Figure 5:
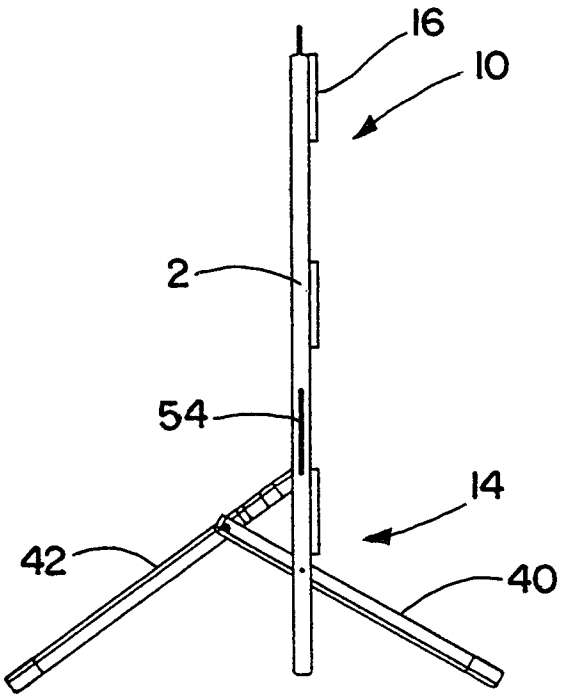
FIG. 5 is a side elevation view of the unfolded barricade assembly of FIG. 4 as seen from the left side thereof.

The leg assembly 14 that is used to support the uprights 12 in a generally upright position when in the fully unfolded position shown in FIGS. 1-5 comprises a pair of front legs 40 and a pair of back legs 42, each having respective upper ends 44, 46 and lower ends 48, 50. As best seen in FIG. 3, the upper ends 46 of the back legs 42 have a sliding connection 52 with the respective uprights 12. In the example disclosed herein, the sliding connection 52 between the upper ends 46 of the back legs 42 and the respective uprights 12 comprises longitudinal slots 54 in the respective uprights and pins 56 extending outwardly from the upper ends of the back legs for sliding receipt in the respective slots.

The upper ends 44 of the front legs 40 have a pivotal connection 58 with the back legs 42 in axial spaced relation from the upper ends of the back legs. Also the front legs 40 have a pivotal connection 60 with the respective uprights 12 in axial spaced relation from the pivotal connection 58 with the back legs 42 and in axial spaced relation below the lower end 62 of the slot 54 of the sliding connection 52 of the back legs 42 with the respective uprights 12. This allows movement of the front legs and the back legs of each pair in opposite directions between the unfolded position shown in FIGS. 1-5 in which the lower ends 48 of the front legs 40 extend forwardly of the respective uprights and the lower ends 50 of the back legs 42 extend rearwardly of the respective uprights, and the folded position shown in FIGS. 6-9. The pins 56 extending from the upper ends of the back legs engage the lower ends 62 of the slots 54 in the respective uprights to act as stops preventing further unfolding of the leg assembly.

Both the front and back legs 40 and 42 desirably have a thickness substantially corresponding to the thickness of the uprights 12, whereby when the legs are in the folded position, the front and back legs are nested within one another in line with the inner sides 22 of the respective uprights to provide a substantially flat barricade assembly for ease of stacking of a plurality of such barricade assemblies one on top of another during storage and/or transit. Also both the front and back legs, like the uprights, may be made of a suitable plastic material such as high density polyethylene to give them the desired strength and rigidity for supporting the barricade assembly in the substantially upright position.

To facilitate nesting of the front and back legs 40 and 42 within one another, in this example the back legs 42 are laterally inwardly angled intermediate their respective upper ends 46 and the pivotal connection 58 between the back and front legs to provide a sufficient clearance space 70 between the inner sides 22 of the respective uprights 12 and the outer sides 72 of the back legs 42 for receipt of the front legs 40 therebetween when the front and back legs are in the fully folded position shown in FIGS. 6-9.

Figure 7:
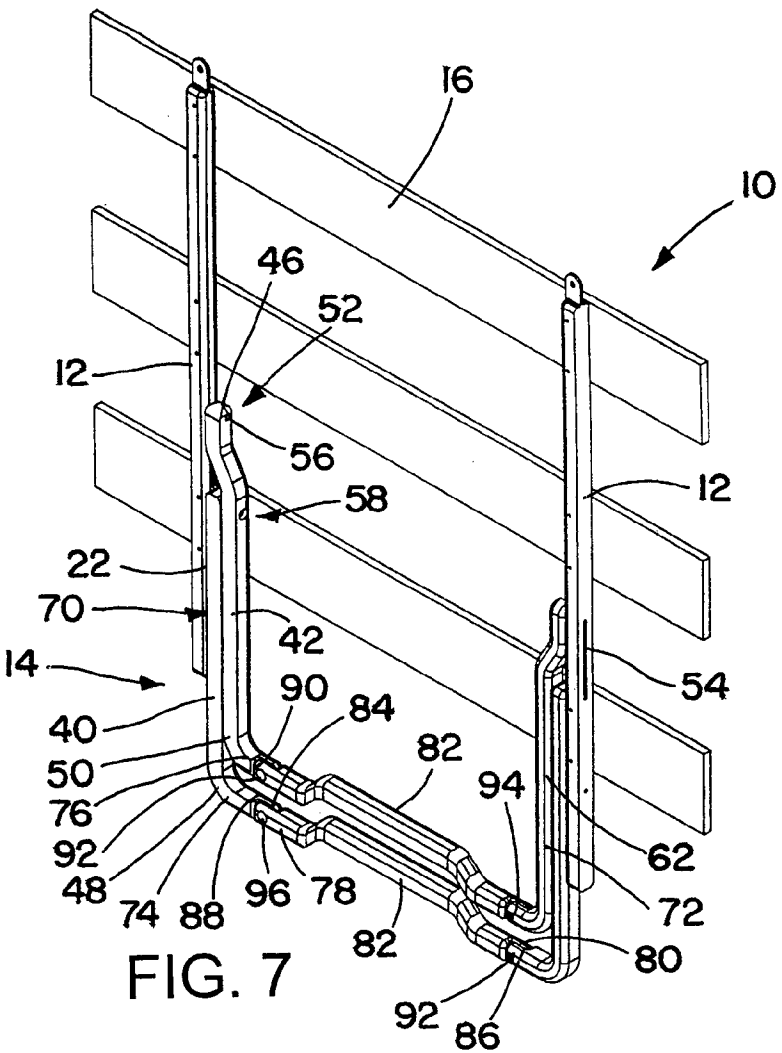
FIG. 7 is a rear perspective view of the folded barricade assembly of FIG. 6.
Figure 6:
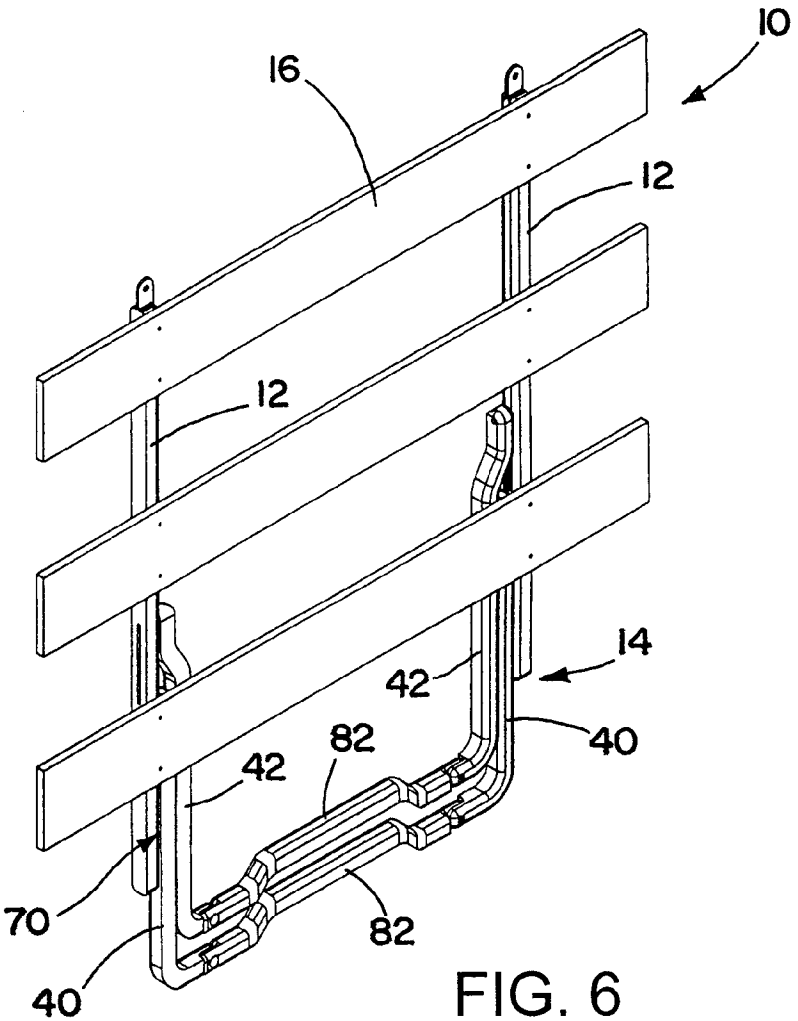
FIG. 6 is a front perspective view of the barricade assembly of FIG. 1 but showing the foldable legs in the folded position.
Figure 8:
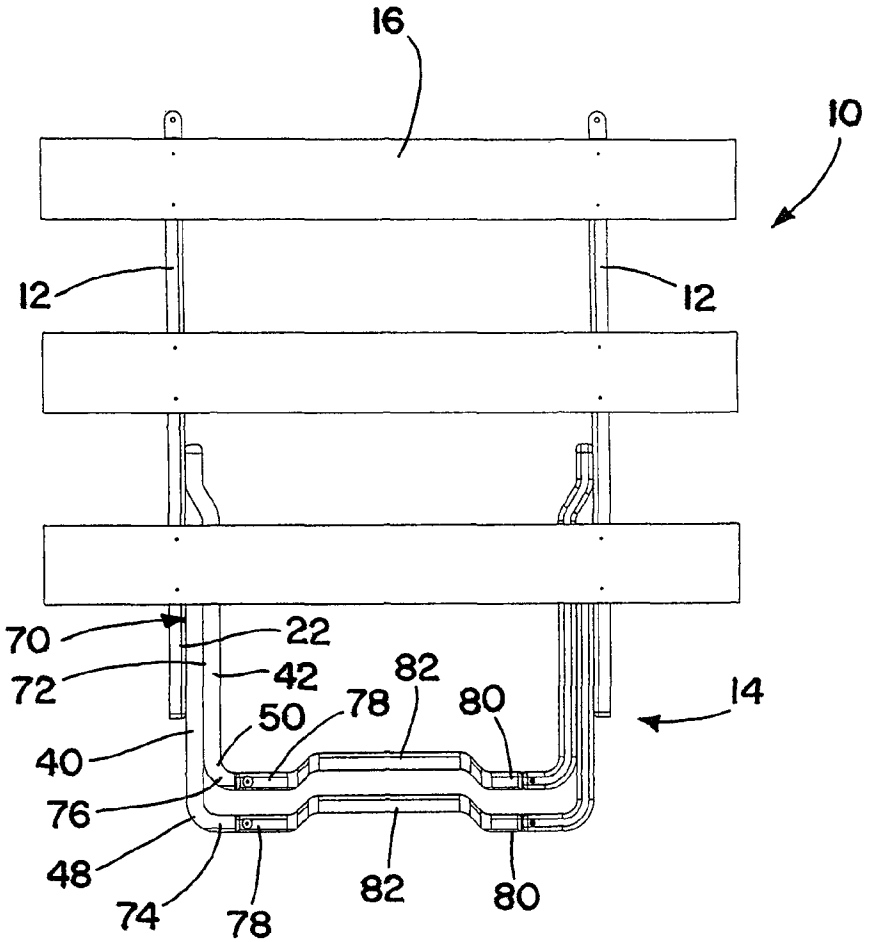
FIG. 8 is a front elevation view of the folded barricade assembly of FIG. 6.
Figure 9:
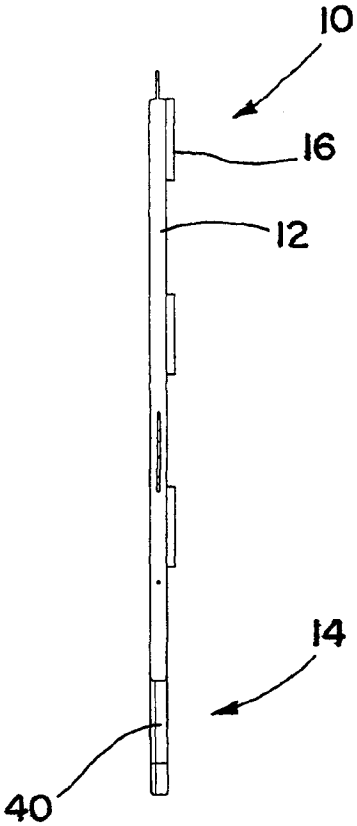
FIG. 9 is a side elevation view of the folded barricade assembly of FIG. 8 as seen from the left side thereof.

As best seen in FIGS. 7 and 8, the lower ends 48 and 50 of the respective front and back legs 40 and 42 desirably have inturned ends 74 and 76 that are connected to opposite ends 78, 80 of respective cross bars 82 that may (but need not) be substantially identical in size and shape. In that event, the inturned ends 76 of the back legs 42 may be shorter than the inturned ends 74 of the front legs 40 by a length substantially corresponding to the thickness of the front legs to provide substantially the same spacing between the inturned ends of the respective front and back legs for connection of the inturned ends of the respective front and back legs to the opposite ends of the respective cross bars. Moreover, the opposite ends 78, 80 of the cross bars 82 may have respective forwardly and rearwardly facing flanges 84, 86 that overlap respective rearwardly and forwardly facing flanges 88, 90 and 92, 94 of the lower inturned ends of the respective front and back legs 40 and 42 for ease of connecting the front and back legs to the respective cross bars using suitable fasteners 96 extending through the overlapped flanges (see FIG. 7). This allows not only the respective cross bars 82 to be substantially identical in size and shape, but if desired the respective front legs 40 and the respective back legs 42 may also be substantially identical in size and shape, which has the advantage that the leg assembly 14 would only require a total of three separate molded parts, namely, two each of the front legs 40, back legs 42, and cross bars 82.

Figure 1:
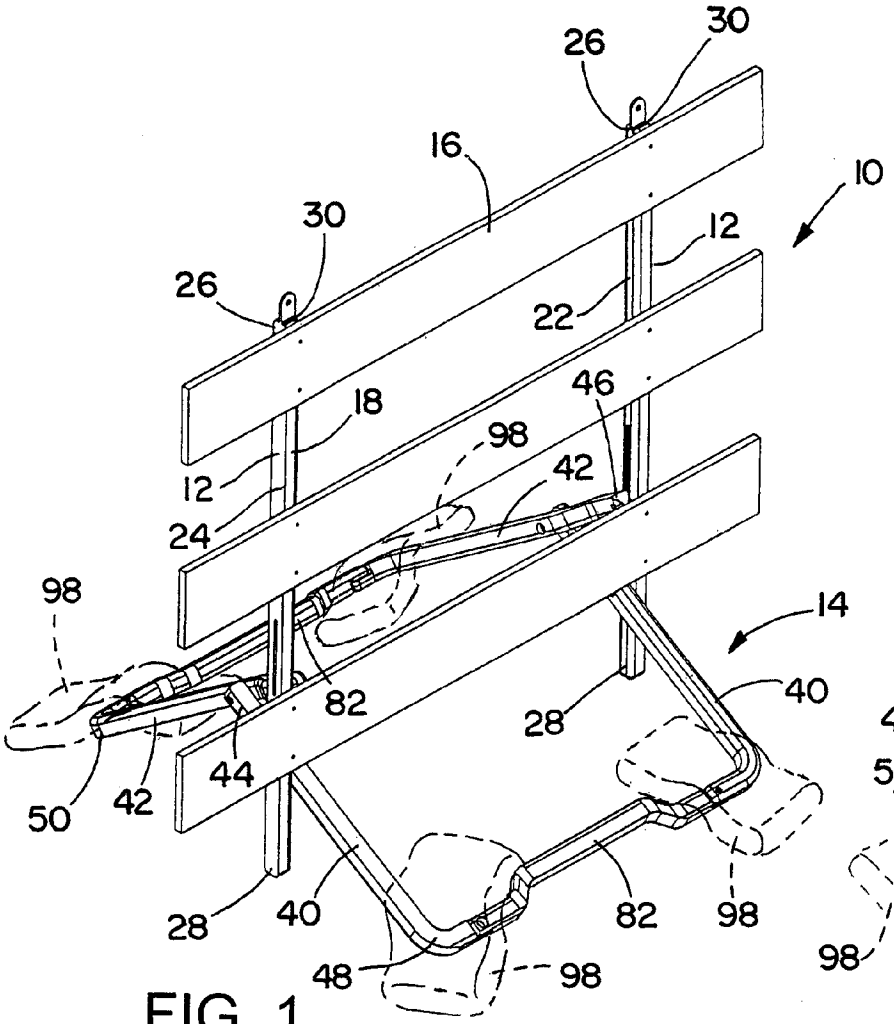
FIG. 1 is a front perspective view of an exemplary barricade assembly of the present invention with foldable legs shown in the fully unfolded position.

Preferably the respective cross bars 82 are raised intermediate their ends to avoid ground contact thus allowing for four points of contact with the ground at the lower ends 48 and 50 of the respective front and back legs 40 and 42 as shown in FIGS. 1 and 2. Also if desired, one or more sandbags or other weights may be placed over the lower ends of the respective front and back legs or one or both cross bars when the front and back legs are in the fully unfolded position for increased weight. Four such sandbags 98 are shown in phantom lines placed over the lower inturned ends of the respective front and back legs in FIGS. 1 and 2.

Preferably two barricade boards 16 and more preferably three barricade boards are attached to the front sides of the uprights 12 in longitudinally spaced relation to one another. Moreover, the pivotal connection 60 between the front legs 40 and the respective uprights 12 is slightly below the bottom edge of the lowermost barricade board, and the longitudinal slots 54 in the respective uprights 12 extend between the bottom edge of the second lowermost barricade board and the top edge of the lowermost barricade board. This allows the respective front and back legs 40 and 42 to extend further out beyond the respective front and back sides of the uprights when in the fully unfolded position to provide better support for the barricade assembly against tipping and yet minimizes the extent to which the respective front and back legs extend outwardly beyond the lower ends 28 of the uprights when in the fully folded position.

In one example, the lower ends 50 of the rear legs 42 preferably extend rearwardly beyond the back sides 20 of the uprights 12 a distance of between approximately 25 inches and approximately 30 inches and more preferably approximately 28 inches, and the lower ends 48 of the front legs 40 preferably extend forwardly beyond the front sides 18 of the uprights a distance of between approximately 15 inches and approximately 20 inches and more preferably approximately 17 inches when the front and back legs are in the fully extended position shown in FIGS. 1-5.

When the leg assembly is in the fully folded position with the rear legs 42 and the respective cross bar 82 nested within the front legs 40 and respective cross bar 82 as shown in FIGS. 6-9, the lower ends 48 of the front legs 42 may extend several inches below the lower ends 28 of the uprights 12. Also the lower ends 28 of the uprights 12 preferably extend below the bottom edge of the lowermost barricade board 16 a distance of between approximately 10 inches and approximately 15 inches and more preferably approximately 12 inches. This allows the uprights to be supported by other base supports than the foldable leg assembly of the present invention, if desired, including, for example, the base support disclosed in U.S. Pat. No. 7,111,815, the entire disclosure of which is incorporated herein by reference.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiment of the invention. In addition, while a particular feature of the invention may have been disclosed with respect to only one embodiment, such feature may be combined with one or more other features as may be desired or advantageous to any given or particular application.

What is claimed is:

1. A barricade assembly comprising a pair of laterally spaced uprights, each of the uprights having front and back sides, inner and outer sides, and upper and lower ends, at least one barricade board attached to the front sides of the uprights intermediate the upper and lower ends of the uprights, and a foldable leg assembly for selectively supporting the uprights in a generally upright position, the leg assembly comprising two pairs of legs, the legs of each pair having upper and lower ends, the upper ends of the legs of one of the pairs having a sliding connection with the respective uprights, and the upper ends of the legs of the other pair having a first pivotal connection with the respective legs of the one pair in axial spaced relation from the upper ends of the respective legs of the one pair, and the legs of the other pair having a second pivotal connection with the respective uprights in axial spaced relation from the first pivotal connection and in longitudinal spaced relation below a lower end of the sliding connection of the upper ends of the legs of the one pair with the respective uprights, whereby the legs of each pair are movable between an unfolded position in which the lower ends of the legs of the one pair extend rearwardly of the respective uprights and the lower ends of the legs of the other pair extend forwardly of the respective uprights, and a folded position in which the respective legs of both pairs are nested within one another in line with the inner sides of the respective uprights to provide a substantially flat barricade assembly for ease of stacking of a plurality of such barricade assemblies one on top of another during storage or transit.

2. The barricade assembly of claim 1 wherein the legs of each pair have a thickness substantially corresponding to a thickness of the uprights.

3. The barricade assembly of claim 1 wherein the lower ends of the respective legs of each pair are connected together by respective cross bars.

4. The barricade assembly of claim 1 wherein the sliding connection between the upper ends of the legs of the one pair and the respective uprights comprises longitudinal slots in the respective uprights intermediate the upper and lower ends of the uprights, and pins extending from the upper ends of the legs of the one pair into the respective slots, and wherein the slots have lower ends that are engaged by the pins to act as stops when the legs of the one pair are fully unfolded.

5. The barricade assembly of claim 1 wherein the respective legs of the one pair are laterally inwardly angled intermediate the upper ends of the respective legs of the one pair and the first pivotal connection between the respective legs of the one pair and the respective legs of the other pair to provide sufficient clearance space between the inner sides of the respective uprights and outer sides of the respective legs of the one pair for receipt of the respective legs of the other pair therebetween when the legs of both pairs are in the fully folded position.

6. The barricade assembly of claim 5 wherein the lower ends of the legs of each pair are connected together by respective cross bars, and the legs and respective cross bar of the one pair are nested within the legs and respective cross bar of the other pair when the legs of both pairs are in the fully folded position.

7. The barricade assembly of claim 6 wherein the lower ends of the legs of both pairs extend below the lower ends of the uprights when the legs of both pairs are in the fully folded position.

8. The barricade assembly of claim 6 wherein the lower ends of the legs of the one pair extend rearwardly beyond the back sides of the uprights a greater distance than the lower ends of the legs of the other pair extend forwardly beyond the front sides of the uprights when the legs of both pairs are in the fully unfolded position.

9. The barricade assembly of claim 8 wherein the lower ends of the legs of the one pair extend rearwardly beyond the back sides of the uprights a distance of between approximately 25 inches and approximately 30 inches, and the lower ends of the legs of the other pair extend forwardly beyond the front sides of the uprights a distance of between approximately 15 inches and approximately 20 inches when the legs of both pairs are in the fully unfolded position.

10. The barricade assembly of claim 6 wherein the legs of the one pair are of substantially the same size and shape and the legs of the other pair are of substantially the same size and shape, and the cross bars that connect inner ends of the respective legs of each pair together are of substantially the same size and shape.

11. The barricade assembly of claim 10 wherein the lower ends of the legs of each pair have inturned ends that are connected to opposite ends of the respective cross bars.

12. The barricade assembly of claim 11 wherein the inturned ends of the legs of the one pair are shorter than the inturned ends of the legs of the other pair by a length substantially corresponding to the thickness of the legs of the other pair to provide substantially the same spacing between the inturned ends of the legs of both pairs for connection of the inturned ends of the legs of both pairs to the opposite ends of the respective cross bars.

13. The barricade assembly of claim 12 wherein the opposite ends of the cross bars have respective forwardly and rearwardly facing flanges that overlap respective rearwardly and forwardly facing flanges on the inturned ends of the legs of each pair and are connected together by fasteners extending through the respective overlapped flanges.

14. The barricade assembly of claim 1 wherein at least two barricade boards are attached to the front sides of the uprights in axial spaced relation to one another, and the second pivotal connection between the legs of the other pair and the respective uprights is below a bottom edge of a lowermost one of the barricade boards, and the longitudinal slots in the respective uprights extend between a bottom edge of a second lowermost barricade board and a top edge of the lowermost barricade board to allow the legs of each pair to extend further out beyond the respective front and back sides of the uprights when in the fully unfolded position to provide better support for the barricade assembly against tipping and yet minimize the extent to which the legs of each pair extend outwardly beyond the lower ends of the uprights when the legs of each pair are in the fully folded position.

15. The barricade assembly of claim 14 wherein the uprights extend below the bottom edge of the lowermost barricade board a length of between approximately 10 inches and approximately 15 inches.

* * * * *